United States Patent [19]

Chumney, Jr.

[11] Patent Number: 4,726,385

[45] Date of Patent: Feb. 23, 1988

[54] METHOD OF FABRICATING AN ALL-TOBACCO CIGARETTE CONTROLLING TAR DELIVERY AND AN ALL-TOBACCO CIGARETTE

[75] Inventor: Richard D. Chumney, Jr., Mechanicsville, Va.

[73] Assignee: The American Tobacco Company, New York, N.Y.

[21] Appl. No.: 861,169

[22] Filed: May 9, 1986

[51] Int. Cl.[4] ..... A24D 3/04

[52] U.S. Cl. ..... 131/336; 131/198.2

[58] Field of Search ..... 131/360, 361, 336, 198.1, 131/198.2

[56] References Cited

U.S. PATENT DOCUMENTS

| | | | |
|---|---|---|---|
| 1,718,122 | 8/1929 | DeShon . | |
| 1,772,809 | 4/1930 | Honigbaum . | |
| 1,865,679 | 6/1932 | Colpe . | |
| 2,152,416 | 8/1939 | Molins . | |
| 2,269,995 | 1/1942 | Trane | 131/336 |
| 2,830,596 | 10/1958 | Frankenburt et al. . | |
| 2,934,073 | 4/1960 | Killian | 131/361 |
| 3,046,994 | 7/1962 | Schur | 131/336 |
| 3,219,041 | 3/1965 | Bromberg . | |
| 3,361,139 | 4/1968 | Inoue . | |
| 3,526,904 | 9/1970 | Tamol | 131/336 |
| 3,858,587 | 1/1975 | Cavelli et al. | 131/336 |
| 4,481,960 | 11/1984 | Brooks | 131/336 |

*Primary Examiner*—V. Millin

*Attorney, Agent, or Firm*—Pennie & Edmonds

[57] ABSTRACT

This invention relates to a method of controlling the "tar" delivery of cigarette smoke and more particularly to the method of controlling "tar" delivery of the non-filter cigarette while maintaining resistance to draw and other parameters of the cigarette at acceptable levels.

5 Claims, 1 Drawing Figure

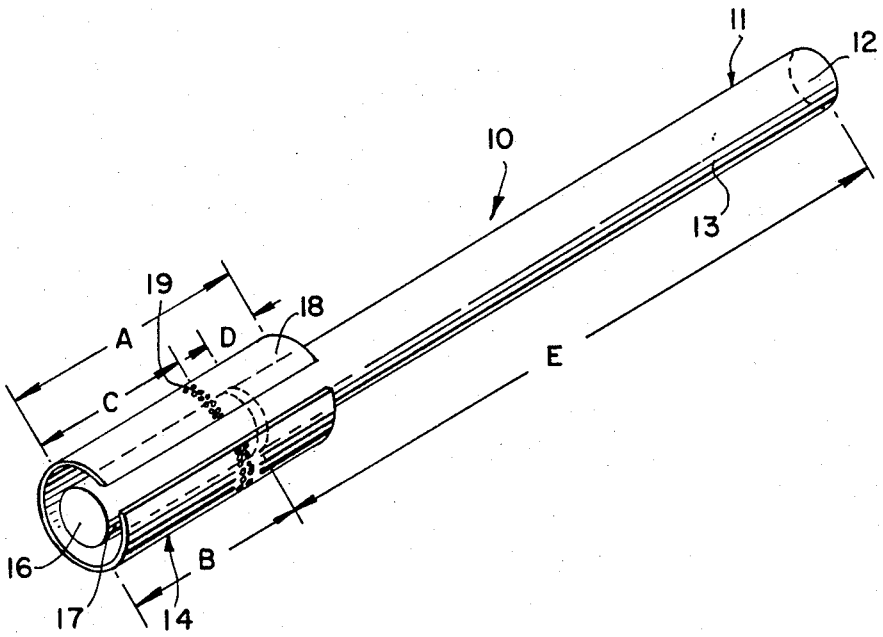
11
12
10
13
19
18
A
D
C
E
16
B
17
14

METHOD OF FABRICATING AN ALL-TOBACCO CIGARETTE CONTROLLING TAR DELIVERY AND AN ALL-TOBACCO CIGARETTE

BACKGROUND OF THE INVENTION

Cigarettes having tobacco throughout their lengths (called "all-tobacco" cigarettes) have included cigarettes with tip ends containing processed tobacco. Such tip ends have had pressure drops greater per mm of length than other portions of the cigarette tobacco column.

Other cigarettes have been suggested with all-tobacco filters or mouthpieces (see U.S. Pat. Nos. 2,152,416, 2,934,073, 3,219,041, and 3,361,139). It has also been proposed to provide a mouthpiece for a cigarette having a flattened mouth end (see U.S. Pat. No. 1,865,679).

Ventilation of tip ends is also well-known including use of tip paper ventilation holes and ventilation passages (see U.S. Pat. No. 3,490,461).

SUMMARY OF THE INVENTION

Broadly, the present invention is in a cigarette fabrication method which comprises the design and construction of an all-tobacco cigarette for delivery of selected quantities (per cigarette) of "tar" to the smoker, which cigarette is formed of two (2) tandemly aligned and connected tobacco columns. The first column is the lighted-end column normally including tobacco blends typically used in present day cigarettes. The second column is the tip end (or mouth end) column which is filled with compacted tobacco, preferably expanded tobacco to control draw resistance (pressure drop) of the cigarette. The tip-end column is overwrapped with a non-porous tipping paper which paper includes a ring of ventilation holes (or other appropriate ventilation passages, holes or other arrangement) located just beyond the normal mouth position of the smoker to contribute to ventilation of the cigarette.

Delivery of "tar" from the cigarette is controlled by varying the lengths of the two (2) columns, the pressure drops of the columns and the ventilation of the cigarette. In particular, delivery of "tar" at acceptable pressure drops is accomplished by varying the tip-end column pressure drop through selection, treatment and compaction of the expanded tobacco in the tip-end column and by varying ventilation by selection of size, location and position of the ventilation holes and the permeability of the tip end column wrap.

With other parameters held constant, delivery of "tar" can be varied by the predetermination of the size, number and position of ventilation holes. The more ventilation introduced into the cigarette, the less "tar" is delivered to the smoker.

It is a feature of the invention that an all-tobacco cigarette capable of low "tar" and ultra-low "tar" delivery is readily attainable while maintaining the resistance to draw (pressure drop) of the cigarette at an acceptable level to the smoker.

BRIEF DESCRIPTION OF THE DRAWINGS

The FIGURE is a partially expanded perspective view of the all-tobacco cigarette of the present invention.

DESCRIPTION OF THE PREFERRED EMBODIMENTS

In the FIGURE cigarette 10 includes both a lighted-end tobacco column 11 with tobacco 12 and a lighted-end paper wrapper 13. Tandemly-connected to lighted-end 11 is tip-end 14 including tobacco 16 and paper wrapper 17. Overwrap non-porous tipping paper 18 (shown in expanded view) is wrapped around tip-end 14 in an overlapping manner and sealed with an adhesive (not shown). Tipping paper 18 has ventilation holes 19. The dimensions shown conform with Example 1.

EXAMPLE 1

Four thousand (4000) cigarettes with an overall length of 84 mm and a circumference of 24.8 mm were fabricated to include two (2) tandemly aligned and connected tobacco columns. The tobacco lighted-end column, forming the burning end of the cigarette with a length E of 64 mm, was composed of a typical domestic tobacco blend (including amounts of expanded tobacco) packed to normal cigarette industry density and wrapped in typical cigarette paper, such as Ecusta Ref. 753 or Kimberly Clark Grade 515. This paper had a Coresta permeability value of 40. The pressure drop for this tobacco column was measured at about 5.5 cm of water. The tobacco column for the tip or mouth end of the cigarette had a length B of 20 mm and was composed entirely of expanded tobacco having a density of 0.181 gm/cc. The paper wrapper for this column had a Coresta value of 26,000. Encapsulated pressure drop for the tip-end 20 mm tobacco column was 6.5 cm of water.

For cigarette making, tip-end tobacco columns were initially prepared in lengths of 120 mm. Standard cigarette making equipment was used to join two 64 mm lighted-end tobacco columns with one 40 mm double tip-end column using a substantially air impervious non-porous paper overwrap 48 mm wide to form a double cigarette. The double cigarette was cut in half to form two (2) cigarettes, each consisting of a 64 mm burning-end tobacco column and a 20 mm tip column joined together with tipping paper providing an overwrap of a width A of 24 mm (see the FIGURE). The tipping paper overlies the entire tip-end column from the mouth end toward the burning-end and, in addition, overlies a section of the burning-end column of a length D of 4 mm. Tipping paper 18 carries a circumferential series of perforations 19 located at a distance C approximately 13 mm from the mouth end. Perforations 19 overlying the very porous tip-end paper 17 allow ingress of air with a resulting dilution of the smoke as the burning cigarette is puffed.

The proper combination of the burning-end tobacco column pressure drop, tip-end column pressure drop and the cigarette ventilation formed a cigarette having acceptable overall resistance to draw of 7.9 cm of water. Pressure drop values represent an average of ten (10) measurements using instrumentation designed to measure resistance to air flow at 17.5 cc/sec. Ventilation provided by the tipping perforations was 51%.

Fifty (50) cigarettes were smoked on a smoking machine using the Federal Trade Commission smoking procedure to provide the following data:

| | |
|---|---|
| Length Smoked (mm) | 57 |
| Puffs/Cigarette | 9.6 |
| "Tar" (mg/cigt) | 13.5 |

-continued

| | |
|---|---|
| (mg/puff) | 1.4 |
| Nicotine (mg/cigt) | 1.0 |
| (mg/puff) | 0.11 |

These cigarettes had an average "tar" delivery of 13.5 mg per cigarette (in the "low 'tar'" range) and an acceptable average draw resistance of 7.9 cm. Ventilation was measured by placing the mouth end of a cigarette in a holder attached to a vacuum source which induces a flow of 17.5 cc/sec at the mouth end. The portion of the 17.5 cc/sec air flow that enters the cigarette through the perforations is the percent ventilation.

EXAMPLE 2

Four thousand (4000) cigarettes with an overall length of 84 mm and a circumference of 24.8 mm were made. The 64 mm burning-end tobacco column was made in the same manner as Example 1. Its pressure drop was measured at about 6.0 cm of water. The 20 mm tip-end tobacco column was composed of 40% expanded tobacco and 60% unexpanded tobacco as compared with 100% expanded tobacco in Example 1. The wrapper for this column had a Coresta permeability of 26,000. Encapsulated pressure drop for the tip-end tobacco column was 6.7 cm of water. The tip-end had a tobacco density of 0.274 gm/cc.

For cigarette making, the tip-ends were first prepared in lengths of 120 mm. Standard cigarette making equipment was used to join two of the 64 mm tobacco columns with one 40 mm double tip-end column using an overwrap of 48 mm wide tipping paper to form a double cigarette. Similarly, when cut this formed two cigarettes, each consisting of a 64 mm burning-end tobacco column and a 20 mm tip column joined together with 24 mm wide tipping paper. The tipping paper contained a series of perforations located approximately 13 mm from the mouth end. Ventilation was 44%.

Again, fifty (50) cigarettes were smoked on a smoking machine using the Federal Trade Commission smoking procedure to provide the following data:

| | |
|---|---|
| Length Smoked (mm) | 57 |
| Puffs/Cigarette | 8.9 |
| "Tar" (mg/cigt) | 14.3 |
| (mg/puff) | 1.6 |
| Nicotine (mg/cigt) | 1.07 |
| (mg/puff) | 0.12 |

These cigarettes had an average "tar" delivery of 14.3 mg per cigarette (in the "low 'tar'" range) and an acceptable average draw resistance of 9.3 cm.

EXAMPLE 3

Four thousand (4000) cigarettes were made in the same manner of Example 1 with the exception of tipping paper. Tipping paper with smaller holes was used to reduce ventilation to 39%. The burning-end column had a pressure drop of about 6.2 cm of water. The wrapper for the tip end column had a Coresta permeability of 26,000 and the encapsulated pressure drop for the tip-end column was 5.5 cm of water. The tip-end had a tobacco density of 0.181 gm/cc.

The fifty (50) cigarettes smoked on a smoking machine using the Federal Trade Commission smoking procedure provided the following data:

| | |
|---|---|
| Length Smoked (mm) | 57 |
| Puffs/Cigarette | 9.1 |
| "Tar" (mg/cigt) | 16.9 |
| (mg/puff) | 1.85 |
| Nicotine (mg/cigt) | 1.22 |
| (mg/puff) | 0.13 |

These cigarettes had an average "tar" delivery of 16.9 mg per cigarette and an acceptable average draw resistance of 8.2 cm.

EXAMPLE 4

Another four thousand (4000) cigarettes with an overall length of 100 mm and a circumference of 24.4 mm were fabricated with a burning-end tobacco column 73 mm long and a pressure drop of about 6.1 cm of water. The tip-end of the cigarette had a length of 27 mm and was composed of about 40% expanded tobacco and 60% unexpanded tobacco. The tip-end had a tobacco density of 0.280 gm/cc. The wrapper for this column had a Coresta permeability of 26,000. Encapsulated pressure drop for this 27 mm tobacco column was 8.5 cm of water.

For cigarette making, these tobacco columns for the tips were first prepared in lengths of 108 mm. Standard cigarette making equipment was used to join two of the 73 mm tobacco columns with one 54 mm double-tip column using an overwrap of 64 mm wide tipping paper to form a double cigarette. When cut this formed two cigarettes, each consisting of a 73 mm tobacco column and a 27 mm tip column joined together with 32 mm wide tipping paper. The tipping paper contained a series of perforations located approximately 13 mm from the mouth end.

The cigarette had an acceptable resistance to draw of 10.8 cm of water for the entire cigarette. Pressure drop values represent an average of ten (10) measurements using instrumentation designed to measure resistance to air flow at 17.5 cc/sec. Ventilation was 39%.

Fifty (50) cigarettes were smoked on a smoking machine using the Federal Trade Commission smoking procedure to provide the following data:

| | |
|---|---|
| Length Smoked (mm) | 65 |
| Puffs/Cigarette | 10.0 |
| "Tar" (mg/cigt) | 13.3 |
| (mg/puff) | 1.3 |
| Nicotine (mg/cigt) | 1.03 |
| (mg/puff) | 0.10 |

These cigarettes had an average "tar" delivery of 13.3 mg per cigarette (in the "low 'tar'" range) and an acceptable average draw resistance of 10.8 cm.

EXAMPLE 5

Four thousand (4000) cigarettes with an overall length of 83 mm and a circumference of 24.9 mm were made. Each cigarette was formed with the two tobacco columns including; burning-end columns and tip-end columns. The burning-end column had a length of 58 mm and was composed of a typical domestic tobacco blend wrapped in typical cigarette paper. Pressure drop of this tobacco column was about 6.2 cm of water. The tip-end of the cigarette had a length of 25 mm and was composed of 100% expanded tobacco. The tip-end tobacco density was 0.225 gm/cc. The wrapper for this column had a Coresta permeability of 26,000. Encapsulated pressure drop for this 25 mm tobacco column was 8.3 cm of water.

For cigarette making, tip-ends were first prepared in lengths of 100 mm. Standard cigarette making equipment was used to join two of the 58 mm tobacco columns with one 50 mm double-tip column using an overwrap of 60 mm wide tipping paper to form a double cigarette. When cut this formed two (2) cigarettes, each consisting of a 58 mm tobacco column and a 25 mm tip column joined together with 30 mm wide tipping paper. The tipping paper contained a series of perforations located approximately 13 mm from the mouth end.

The cigarette had an acceptable resistance to draw of 7.1 centimeters of water for the entire cigarette. Pressure drop values represent an average of 10 measurements using instrumentation designed to measure resistance to air flow at 17.5 cc/sec. Ventilation was 72%.

Fifty (50) cigarettes were smoked on a smoking machine using the Federal Commission smoking procedure to provide the following data:

| | |
|---|---|
| Length Smoked (mm) | 50 |
| Puffs/Cigarette | 9.4 |
| "Tar" (mg/cigt) | 4.5 |
| (mg/puff) | 0.5 |
| Nicotine (mg/cigt) | 0.35 |
| (mg/puff) | 0.04 |

These cigarettes had an average "tar" delivery of 4.5 mg per cigarette (in the "ultra-low 'tar'" range) and an acceptable average draw resistance of 7.1 cm.

The ratio of the length of the tip-end column to the overall length of the cigarette should (expressed as a percentage) be about 16% to about 50%; preferably in the range of 24% to 30%. The pressure drop for an 84 mm cigarette may vary between about 5.0 cm and about 12.0 cm but preferably in the range of 7 cm to 9 cm which is the range of pressure drop for current commercial non-filter 84 mm cigarettes. "Tar" delivery may range from 1–20 mg but a 4–15 mg range is preferred.

"Tar" delivery can be controlled to provide as low as 1 mg tar or lower per cigarette. At 1 mg "tar" delivery the percent ventilation will be about 85% to about 90%. "Tar" delivery can also be increased to as high as twenty (20) mg "tar" or higher per cigarette. At 20 mg "tar" delivery the percent ventilation will be about 10 to 15%.

Expanded tobacco used in the mouth end columns and referred to in the above examples had a filling capacity of approximately 7.5 cc/gm. This tobacco prior to expansion had a filling capacity of approximately 5.0 cc/gm. The tobacco was therefore expanded about 50%.

As illustrated in the Examples, the tip-end column may be composed of all expanded tobacco or a portion of expanded and a portion of unexpanded tobacco. Alternatively, cigarette tobaccos, such as burley, having selected density and filling capacity may be substituted for expanded tobacco.

During formation of the tip-end columns control of the rate of feed of tobacco into the forming paper column provides a means for varying the amount of tobacco per centimeter of column length and thereby varies the density and pressure drop. Tip-end densities may vary from about 0.122 to about 0.300 gm/cc.

The fraction of tip-end tobacco that has been expanded may be as little as 20% or as much as 100%. Percent ventilation of the cigarette should preferably be in the 35% to 75% range.

Finally, with further reference to FIG. 1, ventilation of tip-end 14 may alternatively, if desired, be accomplished by using an overwrap sufficiently porous to permit air to flow through it. Thus, ventilation holes, as the phrase is used herein, include passages, holes or other opening existing in the overwrap as fabricated as well as holes formed in the overwrap after original fabrication. Such perforation holes are formed by mechanical or other means.

I claim:

1. An all-tobacco cigarette in which combustion of the tobacco creates "tar" which "tar" migrates during puffing to the mouth-end for delivery to the smoker comprising (a) a first paper-wrapped column of cut tobacco forming the lighted-end of the cigarette;

(b) a second paper-wrapped column of tobacco tandemly-positioned with respect to the first column forming the tip-end column of the cigarette;

(c) overwrap tipping paper overwrapping the second column and a portion of the first column to secure the two columns together;

(d) ventilation holes of selected number and size in the overwrap at a predetermined distance from the mouth end of the cigarette; and (e) tobacco in the second column including at least about 20% expanded tobacco and the remainder unexpanded tobacco compacted to a density substantially equal to the density of the cut tobacco of the first paper-wrapped column to provide a selected resistance to the draw of the cigarette, whereby a predetermined amount of "tar" is delivered in the form of diluted smoke to the smoker.

2. The all-tobacco cigarette of claim 1 having a draw resistance between about 5.0 cm and about 12.0 cm and a "tar" delivery between about 1 mg and about 20 mg.

3. The all-tobacco cigarette of claim 1 in which the tip-end column comprises between about 16% and about 50% of the overall length of the cigarette.

4. The all-tobacco cigarette of claim 1 in which the ventilation holes ventilate the cigarette by an amount between about 35% and about 75%.

5. The all-tobacco cigarette of claim 1 in which the tip-end tobacco density is between about 0.122 and about 0.300 gm/cc.

* * * * *